US005671528A

United States Patent [19]

Endo et al.

[11] Patent Number: 5,671,528

[45] Date of Patent: Sep. 30, 1997

[54] APPARATUS FOR CRIMPING ELECTRICAL TERMINALS

[75] Inventors: Takayoshi Endo; Yuji Hatagishi, both of Shizuoka, Japan

[73] Assignee: Yazaki Corporation, Tokyo, Japan

[21] Appl. No.: 598,805

[22] Filed: Feb. 9, 1996

[30] Foreign Application Priority Data

Feb. 17, 1995 [JP] Japan ..... 7-029140

[51] Int. Cl.[6] ..... H01R 43/042

[52] U.S. Cl. ..... 29/753; 29/863; 72/413

[58] Field of Search ..... 29/753, 761, 748, 29/33 M, 863; 72/413

[56] References Cited

U.S. PATENT DOCUMENTS

| | | | |
|---|---|---|---|
| 4,067,105 | 1/1978 | Zahn et al. | 29/748 |
| 5,277,050 | 1/1994 | DeRoss et al. | 29/753 |
| 5,355,582 | 10/1994 | Saito et al. | 29/748 |
| 5,456,005 | 10/1995 | Satoh et al. | 29/753 |

FOREIGN PATENT DOCUMENTS

| | | |
|---|---|---|
| 49-67183 | 6/1974 | Japan . |
| 53-147992 | 12/1978 | Japan . |
| 61-153988 | 7/1986 | Japan . |

*Primary Examiner*—Larry I. Schwartz
*Assistant Examiner*—Adrian L. Coley
*Attorney, Agent, or Firm*—Armstrong, Westerman, Hattori, McLeland, and Naughton

[57] ABSTRACT

An anvil (5) has a receiving surface (20) to receive an electrical terminal (4) and a punching hole (6) penetrating through the anvil (5) with an opening in the receiving surface (20). A crimper (2) has a curved surface to crimp the terminal (4). An auxiliary punch (8) has a protrusion (7) that can pass through the punching hole (6) to extend from the opening in the receiving surface (20). A wire core portion (25) is crimped to the electrical terminal (4) between the crimper (2) and the anvil (5). Then, the auxiliary punch (8) strikes out a crimped portion (21) to form a concave portion (27) in the state that the crimped portion (21) is compressed by the crimper (2) and the anvil (5).

5 Claims, 6 Drawing Sheets

APPARATUS FOR CRIMPING ELECTRICAL TERMINALS

BACKGROUND OF THE INVENTION

1. Field of the Invention

This invention relates to an apparatus for, and a method of crimping, electrical terminals to obtain improved electrical continuity between a terminal and an electric wire by forming a concave portion in a crimped terminal after the electric wire has been crimped to the terminal.

2. Description of the Prior Art

There are shown, in FIGS. 6 and 7, illustration of a prior art electrical terminal crimping method disclosed in Japanese Patent Application laid-open No. 53-147992.

In the method, as shown in FIG. 6, a crimping portion 32 of a terminal 31 is provided with a plurality of small, inwardly pointing protrusions 33 and a stripped core portion 35 of a wire 34 is put on the crimping portion 32. Then, as shown in FIG. 7, the crimping portion 32 is inwardly compressed between a crimper (an upper die) 36 and an anvil (a lower die) 37 so that the small protrusions 32 penetrate into the wire core portion 35. The small protrusions 33 serve to obtain improved electrical continuity and a more secure joint between the crimping portion 32 and the wire core portion 35.

However, the above-mentioned prior art has a drawback in that, as shown in the FIG. 8, in terminal crimping operation, the small protrusions 33 damage the wire core portion 35 by cutting wire cores 35*a* or that, as shown in FIG. 9, the wire cores 35*a* may be removed from the small protrusions so that the small protrusions 33 do not strike appropriately into the wire core portion 35.

SUMMARY OF THE INVENTION

In view of the aforementioned drawbacks, an object of the invention is to provide an apparatus for, and a method of, crimping electrical terminals that obtain improved electrical continuity and a more secure joint between a wire core portion and a terminal crimping portion without cutting wire cores and producing insufficient contact between the wire core portion and the terminal crimping portion.

To achieve the above-mentioned object, this invention provides a terminal crimping apparatus that includes an anvil having a receiving surface to receive an electrical terminal and a punching hole penetrating through the anvil and having an opening in the receiving surface; a crimper having a curved surface to crimp the terminal; and an auxiliary punch having a protrusion that can pass through the punching hole to extend from the opening in the receiving surface.

Further, this invention provides a terminal crimping method which includes the steps of crimping a wire core portion to an electrical terminal between a crimper and an anvil, and forming a concave portion in a crimped portion by an auxiliary punch in the state that the crimped portion compressed by the crimper and the anvil.

Referring to operation of the invention, first, the terminal is put on the anvil and the wire core portion is set on the terminal. Next, the crimper and the anvil carry out a pressing operation so that the wire core portion is crimped by, and connected to, the terminal. The wire core portion, crimped by the terminal crimping portion is kept compressed with no relief clearance by the crimper and the anvil. In this state, the auxiliary punch extends through the anvil and directly contacts the crimped portion of the terminal and deforms it into the wire core portion. Thereby, the wire core portion makes tighter contact with the terminal crimping portion.

DETAILED DESCRIPTION OF PREFERRED EMBODIMENTS

Figure 1:
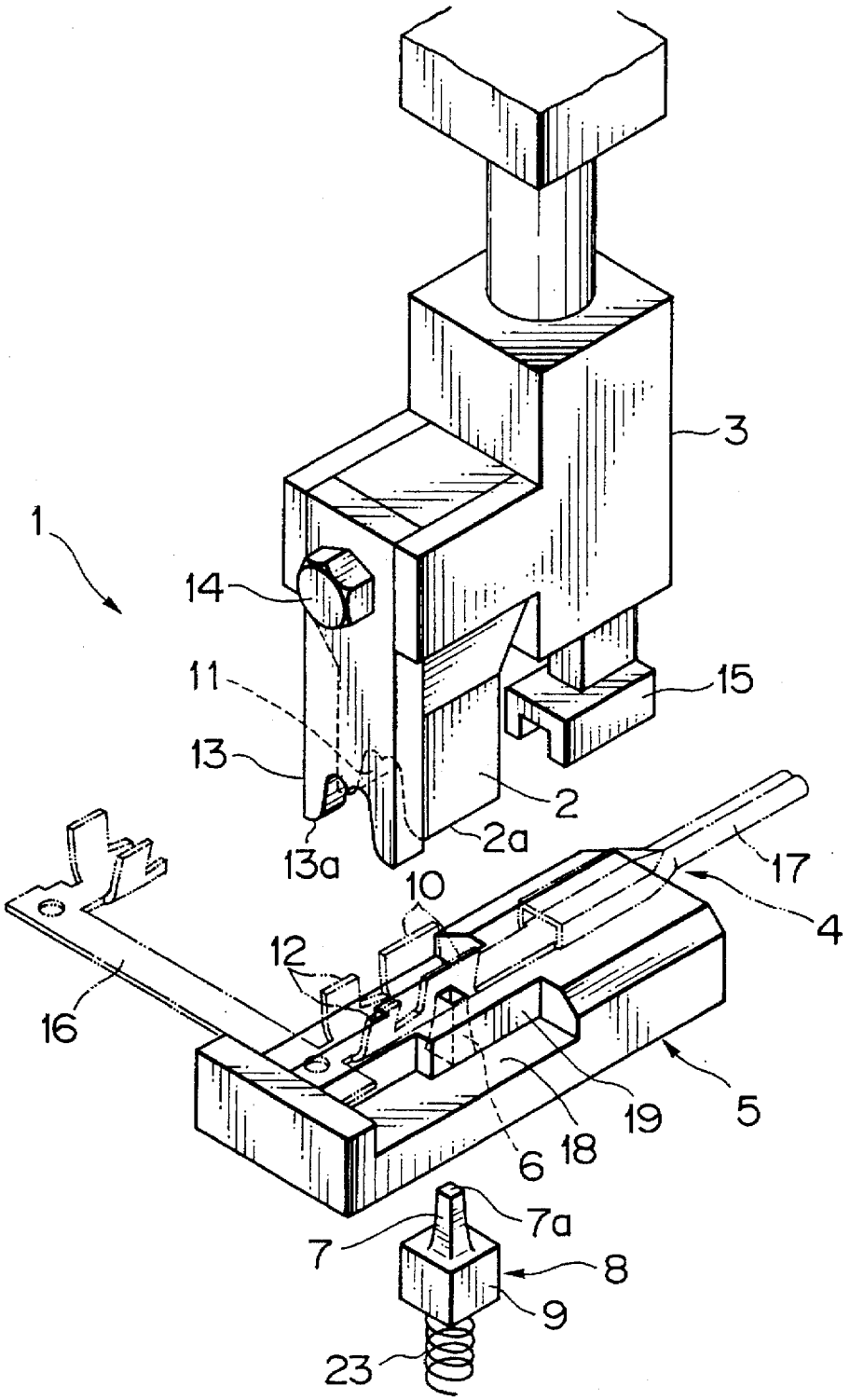
FIG. 1 is a perspective view showing an embodiment of a terminal crimping apparatus according to this invention.
Figure 2:
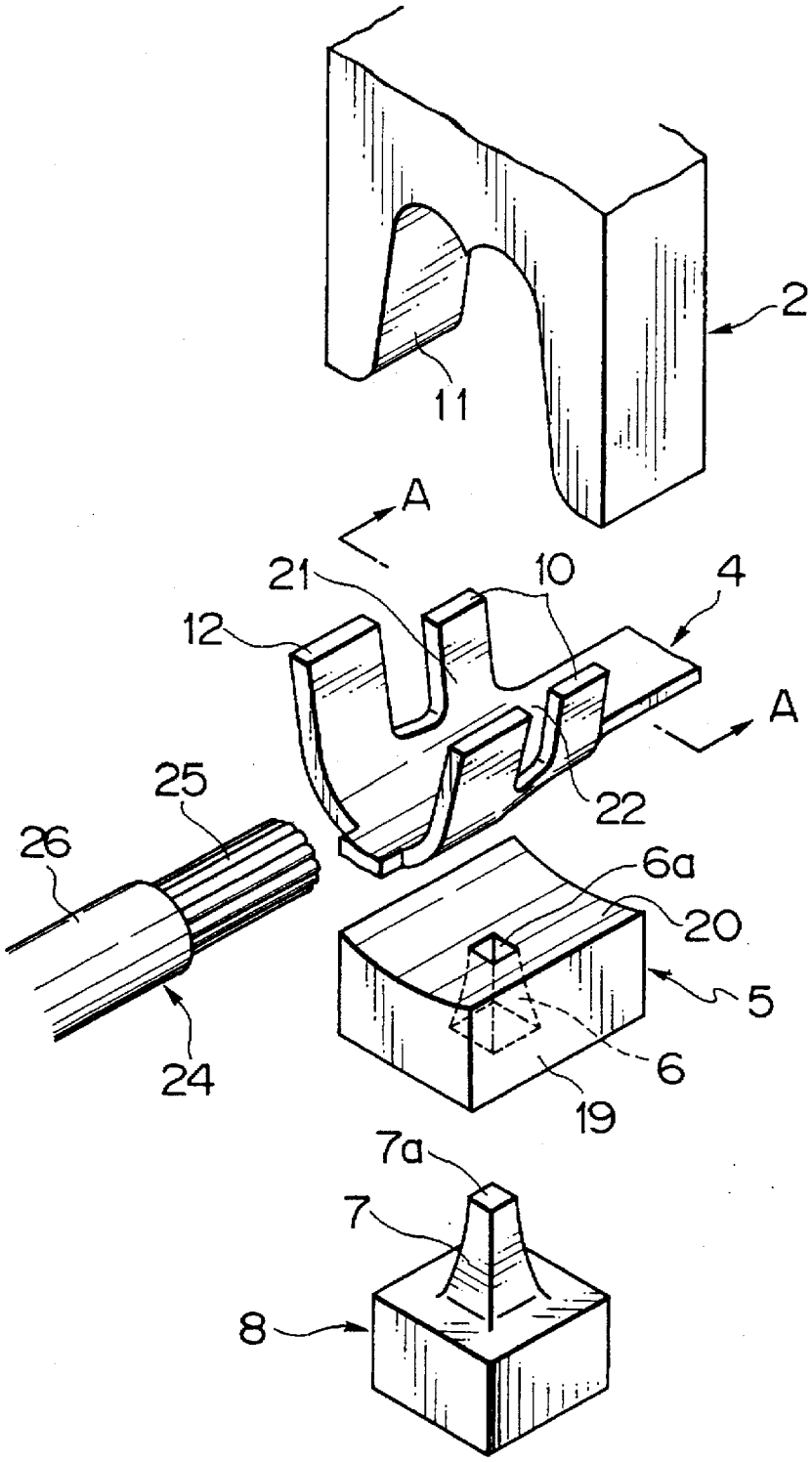
FIG. 2 is an exploded, perspective view showing primary parts of the terminal crimping apparatus in FIG. 1.

FIG. 1 shows a terminal crimping apparatus according to the present invention and FIG. 2 shows primary parts of a terminal crimping apparatus for the same.

This terminal crimping apparatus 1, as shown in FIG. 1, includes an upwardly and downwardly movable upper press 3 having crimper 2, a fixed anvil 5 to put a terminal 4 thereon, an auxiliary punch 8, a nose 7*a* of which being enabled to pass through and to protrude from a punching hole 6 formed in the anvil 5, and a lower press (not shown) upwardly moving the auxiliary punch 8.

The crimper 2 is positioned to oppose a pair of conductive crimping barrels 10 of the terminal 4 and has a pair of crimping curved surfaces 11 corresponding to the pair of conductive crimping barrels 10. The anvil 5 has a punching hole 6 formed to oppose the crimper 2. In the rear of the crimper 2 there is provided another crimper corresponding to a pair of crimping barrels 12 in the terminal 4 so as to crimp an insulated wire portion, the other crimper being detachably secured by bolts 14. In front of the crimper 2 there is provided a terminal holding piece 15. The terminal 4 is set on the anvil 5 while being connected to another terminal by a connection plate 16.

The anvil 5 supports the terminal 4, except for an electrical contact portion 17 provided in a leading end of the terminal. The anvil also has a receiving recess 18 to receive noses 2*a*, 13*a* of the crimpers 2, 13. A bed plate 19 to retain the crimping barrels 10 of the terminal 4, as shown in FIG. 2, has a receiving, concave surface 20 with a small curvature. In the bed plate 19 there is provided a punching hole 6 positioned corresponding to a conductive piece crimping portion 21 of the terminal 4, that includes the pair of conductive crimping barrels 10 and a bottom plate 22 from which the conductive crimping barrels 10 extend. An upper opening 6*a* of the punching hole 6 is located at the center of the receiving surface 20.

The auxiliary punch 8 has a substantially crest-shaped protrusion 7 with a transverse rectangular section and a base block 9 securing the protrusion 7. The auxiliary punch 8, as shown in FIG. 1, is normally upwardly biased by a coil spring 23 so that the nose 7*a* of the protrusion 7 protrudes from the upper opening 6*a* of the punching hole 6. The nose 7*a* a has the foremost end with a flat, rectangular surface. The nose 7*a* of the auxiliary punch 8 can retreat into the punching hole 6 when pressed by the terminal 4 in accordance with downward motion of the upper press 3.

Figure 4:
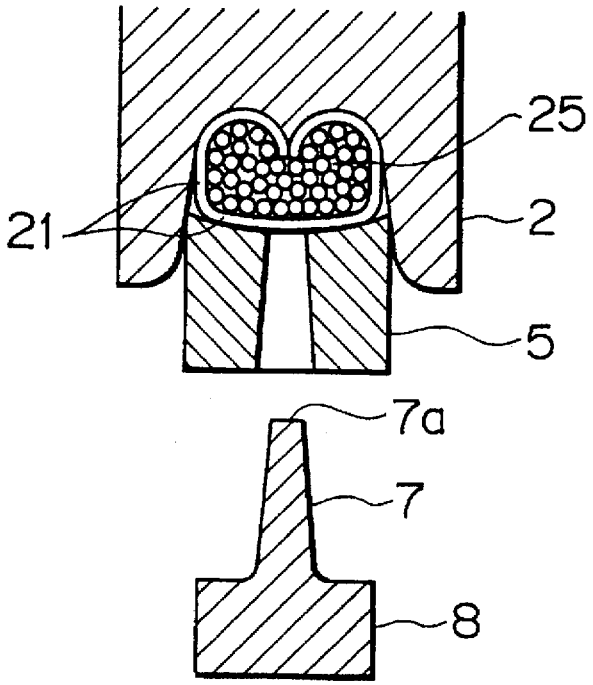
FIG. 4 is a sectional view showing a crimped state of the terminal in a terminal crimping method according to the present invention.
Figure 5:
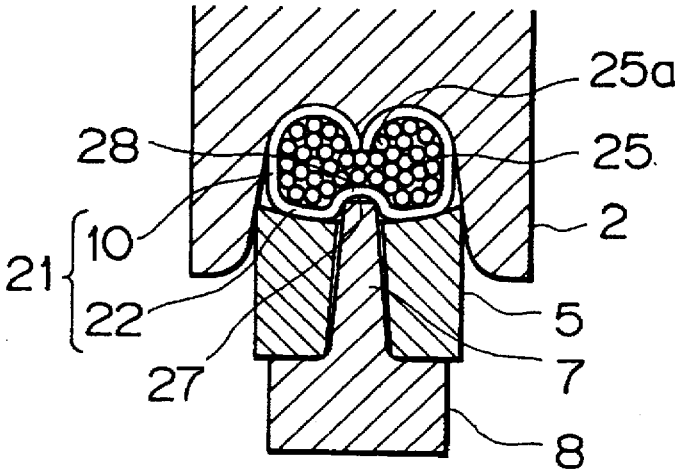
FIG. 5 is a sectional view showing the state that a concave portion is formed by an auxiliary punch in the terminal crimping method according to the present invention.
Figure 6:
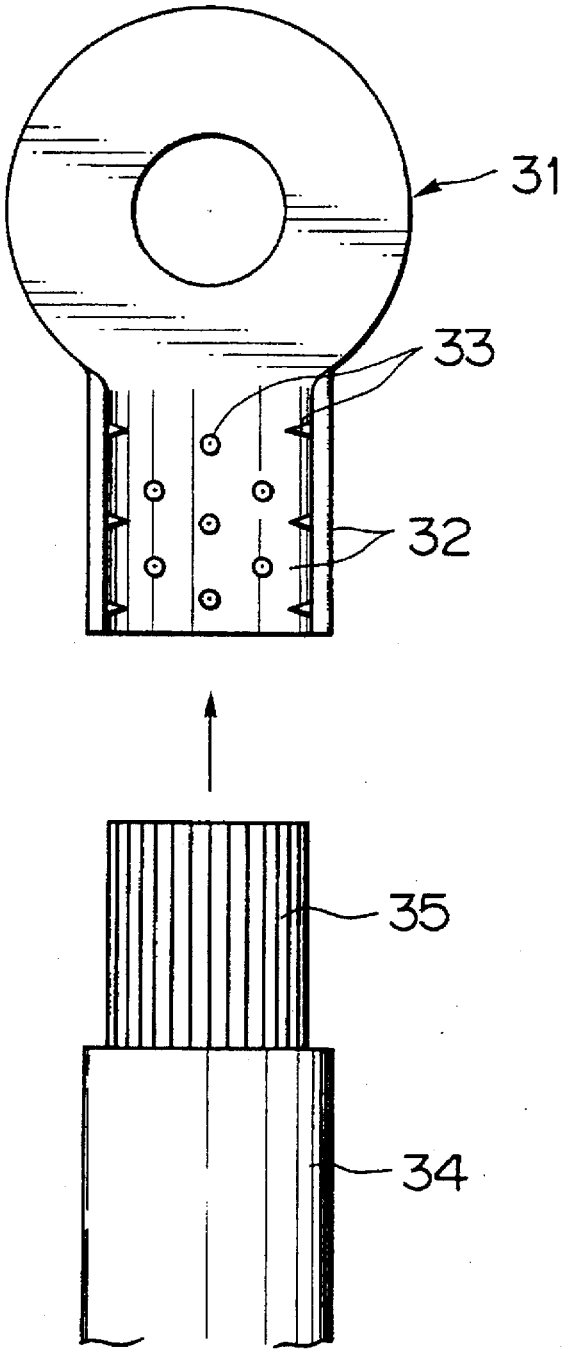
FIG. 6 PRIOR ART
FIG. 6 is a plan showing a terminal and a wire in a prior art arrangement.
Figure 7:
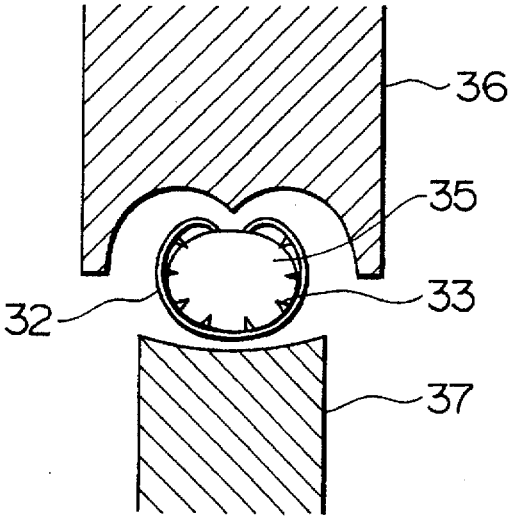
FIG. 7 PRIOR ART
FIG. 7 is a longitudinal sectional view showing the manner in which the wire is crimped to the terminal in the prior art.
Figure 8:
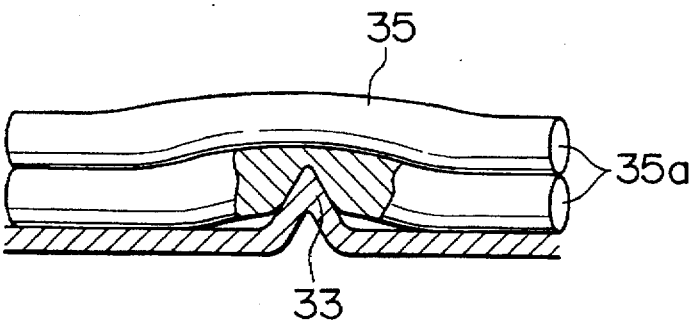
FIG. 8 PRIOR ART
FIG. 8 a sectional view explaining a drawback in the prior art method.
Figure 9:
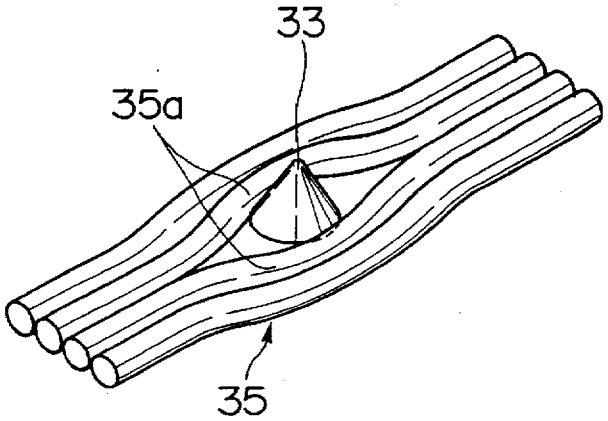
FIG. 9 PRIOR ART
FIG. 9 is a perspective view explaining another drawback in the prior art method.

In FIG. 2, with regard to wire 24, a wire core portion 25 is set between the fore crimping barrels 10 and an insulated portion 26 of the wire is set between the rear crimping barrels 12. Then, as shown in FIGS. 3 and 4, a crimping operation is carried out and further a concave portion 27, as shown in FIG. 5, is formed in the fore, conductive crimping portion 21 by the auxiliary punch 8.

Figure 3:
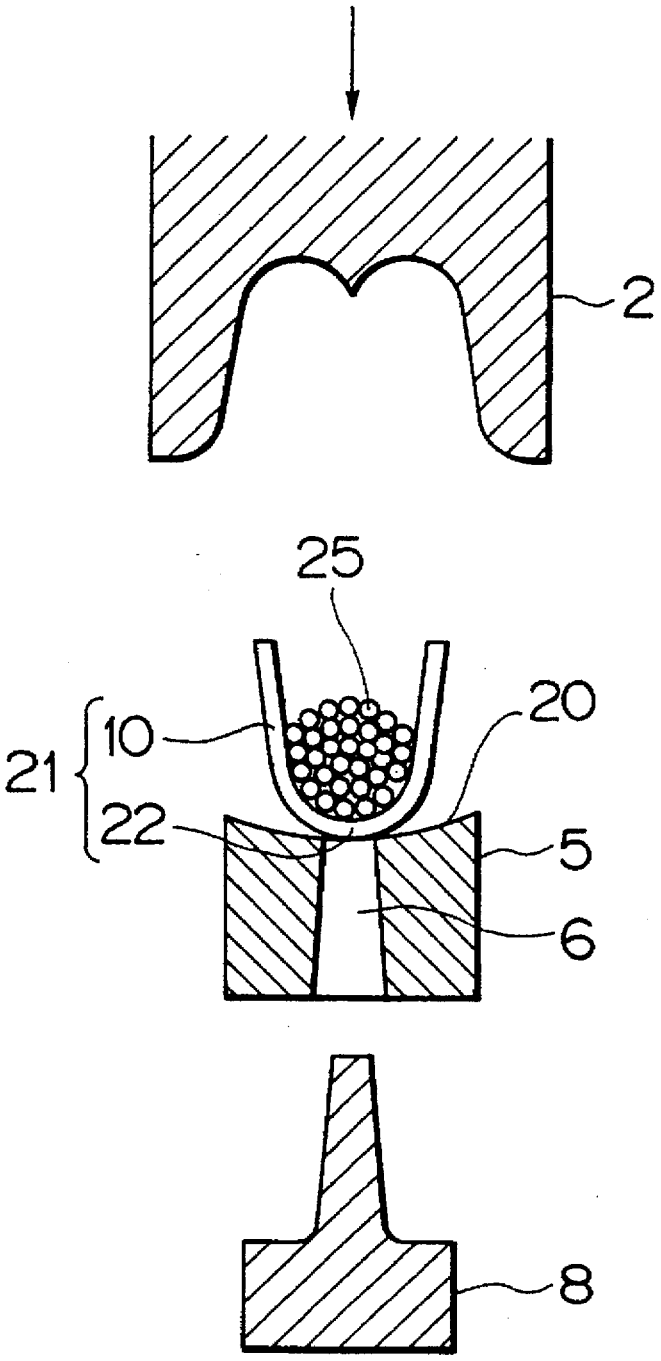
FIG. 3 is a sectional view taken along a line A—A, which shows a terminal crimping method according to the present invention.

FIG. 3 is a sectional view taken along a line A—A in FIG. 2 and shows that the conductive crimping portion 21 the terminal 4 is positioned just above the receiving surface 20 of the anvil 5. Successively, the crimper 2, as shown in FIG. 4, moves downward toward the anvil 5 so that the wire core portion 25 is crimped by, and connected to, the conductive crimping portion 21. In the state that the anvil 5 and crimper 2 hold the terminal 4 with the crimped wire, that is, in the state that the crimper 2 has moved downward so that the conductive crimping portion 21 of the terminal 4 has been compressed between the anvil 5 and the crimper 2, the auxiliary punch 8, as shown in FIG. 5, is moved upward so that the nose 7*a* of the protrusion 7 in the auxiliary punch 8 forms a concave portion 27 in the terminal bottom plate 22 of the conductive crimping portion 21.

The conduct crimping portion 21 is restricted from the outside by the anvil 5 and crimper 2, which inhibits a spring-back of the crimping portion 21. In this state, the convex portion 28 is struck out in the rear side of the concave portion 27 toward the wire core portion 25 with the wire core portion 25 being compressed within the conductive crimping portion 21. Thereby, the wire core portion 25 makes a tight contact with the inner surface of the conduct crimping portion 21 and, at the same time, each wire core 25*a* makes a tight contact with each other.

Therefore, according to this invention, the crimped portion is struck by the auxiliary punch in the state that the anvil and the crimper have compressed the crimping portion of the terminal holding the wire core portion, which can form the concave portion with only a little change in the shape of the crimping portion. Thereby, the wire core portion makes a tight contact with the convex portion in the rear side of the concave portion, because the convex portion presses into the wire core portion having no relief clearance. Accordingly, a remarkably improved, reliable electrical continuity may be accomplished. Further, as the nose of the auxiliary punch is formed not to be sharpened, the disadvantage of cutting wire cores, which is referred in the prior art, can be eliminated.

What is claimed is:

1. A terminal crimping apparatus for crimping a conductive barrel of an electrical terminal to a stripped wire composed of a plurality of cores comprising:

an anvil having a receiving surface to receive the terminal and a punching hole penetrating through said anvil with an opening in the receiving surface;

a crimper having a curved surface to crimp the terminal; wherein said crimping is performed between said crimper and said anvil;

an auxiliary punch having a protrusion that can pass through said punching hole to extend from the opening in the receiving surface, wherein said protrusion has a sectional area radially smaller than a base block of said auxiliary punch, and said base block has a sectional area larger than said punching hole to prevent said base block from entering said punching hole.

2. A terminal crimping apparatus as claimed in claim 1, further comprising a press that upwardly moves said auxiliary punch.

3. A terminal crimping apparatus as claimed in claim 2, wherein said auxiliary punch is upwardly biased by a coil spring.

4. A terminal crimping apparatus as claimed in claim 1, wherein said protrusion of said auxiliary punch is a crest-shaped protrusion.

5. A terminal crimping apparatus as claimed in claim 4, wherein said protrusion has a foremost end with a flat surface.

* * * * *